US011523469B2

(12) United States Patent
Courbat et al.

(10) Patent No.: US 11,523,469 B2
(45) Date of Patent: Dec. 6, 2022

(54) ELECTRICAL HEATING ASSEMBLY, AEROSOL-GENERATING DEVICE AND METHOD FOR RESISTIVELY HEATING AN AEROSOL-FORMING SUBSTRATE

(71) Applicant: PHILIP MORRIS PRODUCTS S.A., Neuchatel (CH)

(72) Inventors: Jerome Christian Courbat, Neuchatel (CH); Oleg Mironov, Cudrefin (CH)

(73) Assignee: Philip Morris Products S.A., Neuchatel (CH)

( * ) Notice: Subject to any disclaimer, the term of this patent is extended or adjusted under 35 U.S.C. 154(b) by 333 days.

(21) Appl. No.: 16/500,458

(22) PCT Filed: Jun. 27, 2018

(86) PCT No.: PCT/EP2018/067176
§ 371 (c)(1),
(2) Date: Oct. 3, 2019

(87) PCT Pub. No.: WO2019/002330
PCT Pub. Date: Jan. 3, 2019

(65) Prior Publication Data

US 2020/0107579 A1 Apr. 9, 2020

(30) Foreign Application Priority Data

Jun. 28, 2017 (EP) ..... 17178380

(51) Int. Cl.
*A24F 13/00* (2006.01)
*H05B 3/22* (2006.01)
(Continued)

(52) U.S. Cl.
CPC ..... *H05B 3/22* (2013.01); *A24F 40/46* (2020.01); *A24F 40/465* (2020.01); *H05B 6/06* (2013.01);
(Continued)

(58) Field of Classification Search
CPC ..... A24F 47/00
(Continued)

(56) References Cited

U.S. PATENT DOCUMENTS 4,814,587 A 3/1989 Carter
4,990,736 A 2/1991 Henschen
(Continued)

FOREIGN PATENT DOCUMENTS

AT 509 046 6/2011
CN 103987286 A 8/2014
(Continued)

OTHER PUBLICATIONS

PCT Search Report and Written Opinion for PCT/EP2018/067176 dated Sep. 19, 2018 (16 pages).
(Continued)

*Primary Examiner* — Phuong K Dinh
(74) *Attorney, Agent, or Firm* — Mueting Raasch Group

(57) ABSTRACT

The present invention relates to an electrical heating assembly of an aerosol-generating device for resistively heating an aerosol-forming substrate. The heating assembly comprises a control circuit configured to provide an AC driving current. The heating assembly further comprises an electrically resistive heating element comprising an electrically conductive ferromagnetic or ferrimagnetic material for heating the aerosol-forming substrate. The heating element is operatively coupled with the control circuit and configured to heat up due to Joule heating when passing an AC driving element provided by the control circuit current through the heating element. The present invention further relates to an aerosol-generating device for use with an aerosol-forming substrate, wherein the aerosol-generating device comprises a heating assembly according to the invention.

11 Claims, 4 Drawing Sheets

Figure 1:
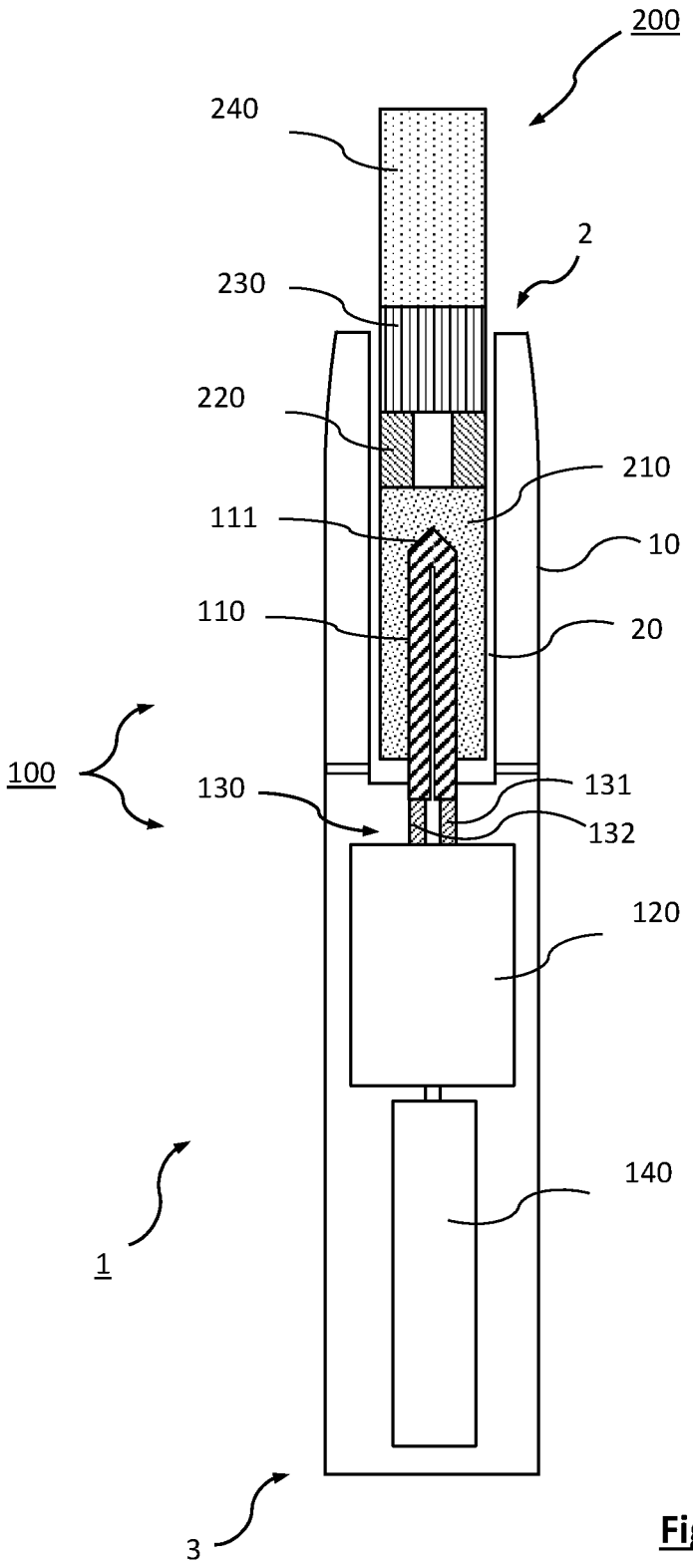

(51) Int. Cl.

| | |
|---|---|
| ***A24F 40/465*** | (2020.01) |
| ***H05B 6/06*** | (2006.01) |
| ***A24F 40/46*** | (2020.01) |
| *A24F 40/20* | (2020.01) |

(52) U.S. Cl.
CPC ..... *A24F 40/20* (2020.01); *H05B 2206/024* (2013.01)

(58) Field of Classification Search
USPC ..... 131/328–329
See application file for complete search history.

(56) References Cited

U.S. PATENT DOCUMENTS

| | | | | |
|---|---|---|---|---|
| 5,666,977 | A | 9/1997 | Higgins | |
| 9,555,199 | B2 | 1/2017 | Buchberger | |
| 9,713,345 | B2 | 7/2017 | Farine | |
| 9,814,263 | B2 | 11/2017 | Cochland | |
| 10,542,779 | B2 * | 1/2020 | Zinovik | G01N 27/4074 |
| 10,729,181 | B2 * | 8/2020 | Zinovik | A24F 40/42 |
| 10,813,174 | B2 | 10/2020 | Schneider | |
| 11,039,642 | B2 | 6/2021 | Zuber | |
| 2015/0090256 | A1 | 4/2015 | Chung | |
| 2016/0109115 | A1 | 4/2016 | Lipowicz | |
| 2017/0340014 | A1 * | 11/2017 | Batista | F22B 1/284 |

FOREIGN PATENT DOCUMENTS

| | | |
|---|---|---|
| CN | 106174706 | 12/2015 |
| DE | 20 2013 010 986 U1 | 2/2014 |
| EA | 25718 | 1/2017 |
| EP | 0 250 094 | 12/1987 |
| EP | 0 845 220 | 6/1998 |
| RU | 2606711 | 1/2017 |
| RU | 2619372 | 5/2017 |
| WO | WO 82/03148 | 9/1982 |
| WO | WO 2016/014652 | 1/2016 |
| WO | WO 2016/050247 | 4/2016 |
| WO | WO 2017/055564 | 4/2017 |

OTHER PUBLICATIONS

Office Action issued in Russia for Application No. 2019136366 dated Sep. 22, 2021 (5 pages). English translation included.
Office Action issued in China for Application No. 201880028217.X dated Sep. 29, 2022 (17 pages). English translation included.

* cited by examiner

ELECTRICAL HEATING ASSEMBLY, AEROSOL-GENERATING DEVICE AND METHOD FOR RESISTIVELY HEATING AN AEROSOL-FORMING SUBSTRATE

This application is a U.S. National Stage Application of International Application No. PCT/EP2018/067176 filed Jun. 27, 2018, which was published in English on Jan. 3, 2019 as International Publication No. WO 2019/002330 A1. International Application No. PCT/EP2018/067176 claims priority to European Application No. 17178380.6 filed Jun. 28, 2017.

The present invention relates to an electrical heating assembly of an aerosol-generating device for resistively heating an aerosol-forming substrate. The invention further relates to an aerosol-generating device comprising such a heating assembly as well as to a method for resistively heating an aerosol-forming substrate.

Generating aerosols by resistively heating an aerosol-forming substrate is generally known from prior art. For this, an aerosol-forming substrate which is capable of forming an inhalable aerosol upon heating is brought in thermal proximity of or even direct physical contact with a resistive heating element. The heating element comprises an electrically conductive material which heats up due to the Joule effect when passing a DC (direct current) driving current therethrough. The heating element may be, for example, a ceramic blade having an electrically conductive metal track formed thereon which heats up when passing a DC driving current through the track. However, due the fragile nature of the ceramic material such heating blades have an increased risk of breakage, in particular when being brought in and out of contact with the aerosol-forming substrate. Alternatively, the heating blade may be made of metal. However, metals have a very low DC resistance which results in low heating efficiencies, adverse power losses and unreproducible heating results. Apart from that, resistive heating typically requires some kind of temperature control in order to avoid an undesired overheating of the aerosol-forming substrate.

Therefore, it would be desirable to have an electrical heating assembly, an aerosol-generating device and a method for resistively heating an aerosol-forming substrate with the advantages of prior art solutions but without their limitations. In particular, it would be desirable to have a heating assembly, an aerosol-generating device and a heating method providing a robust, efficient a possibility for resistively heating an aerosol-forming substrate without the risk of undesired overheating.

According to the invention there is provided an electrical heating assembly of an aerosol-generating device for resistively heating an aerosol-forming substrate. The heating assembly comprises a control circuit configured to provide an AC (alternating current) driving current. The heating assembly further comprises an electrically resistive heating element comprising an electrically conductive ferromagnetic or ferrimagnetic material for heating the aerosol-forming substrate. The heating element is operatively coupled with the control circuit and configured to heat up due to Joule heating when passing an AC driving current—provided by the control circuit—through the heating element. As such, it is the electrically conductive ferromagnetic or ferrimagnetic material of the heating element which the AC driving current passes through.

According to the invention, it has been recognized that the effective resistance and, thus, the heating efficiency of an electrically conductive heating element can be significantly increased by passing an AC driving current, instead of a DC driving current, through the heating element. Unlike DC currents, AC currents mainly flow at the 'skin' of an electrical conductor between an outer surface of the conductor and a level called the skin depth. The AC current density is largest near the surface of the conductor, and decreases with greater depths in the conductor. With increasing frequency of the AC driving current, the skin depth decreases which causes the effective cross-section of the conductor to decrease and thus the effective resistance of the conductor to increase. This phenomenon is known as skin effect which basically is due to opposing eddy currents induced by the changing magnetic field resulting from the AC driving current.

Operating the heating element using an AC driving current furthermore allows the heating element to be substantially made or to substantially consist of an electrically conductive ferromagnetic or ferrimagnetic, in particular solid material while still providing sufficiently high resistance for heat generation. In particular, the heating element may substantially consist of or may be substantially made of a metal, at least for the most part or even entirely. As compared to the above described ceramic heating elements, a heating element which substantially consists or is made of metal significantly increases the mechanical stability and robustness of the heating element and, thus, reduces the risk of any deformation or breakage of the heating element.

Moreover, operating the resistive heating element using an AC driving current also diminishes the influence of undesired capacitive behavior occurring at material transitions within the conductive system of the electrical heating assembly, for example, at welding or soldering points.

According to the invention it has been further recognized that a heating element having an electrically conductive ferromagnetic or ferrimagnetic material for passing the AC driving current therethrough facilities a temperature control and preferably also a self-limitation of the resistive heating process. This is due to the fact that the magnetic properties of the electrically conductive material change with increasing temperature. In particular, when reaching the Curie temperature, the magnetic properties change from ferromagnetic or ferrimagnetic, respectively, to paramagnetic. That is, the magnetic permeability of the electrically conductive material continuously decreases with increasing temperature. A decreasing magnetic permeability in turn causes the skin depth to increase and thus the effective AC resistance of the electrically conductive material to decrease. When reaching the Curie temperature, the relative magnetic permeability drops to about unity, causing the effective AC electrical resistance to reach a minimum. Thus, monitoring a corresponding change of the AC driving current passing through the heating element can be used as temperature marker indicating when the conductive magnetic material of the heating element has reached its Curie temperature. Preferably, the conductive magnetic material of the heating element is chosen such as to have a Curie temperature corresponding to a predefined heating temperature of the aerosol-forming substrate.

Even more, due to the decreasing AC resistance during the ongoing heating process the effective heating rate continuously decreases with increasing temperature. When reaching the Curie temperature, the effective heating rate may be reduced to such an extent that the temperature of the heating element does not increase any longer, though still continuing passing a driving current through the heating element. The temperature of the heating element may even slightly decrease upon reaching the Curie temperature of the conductive magnetic material of the heating element, depending on the heat release to the aerosol-forming substrate. Advantageously, this effect provides a self-limitation of the heating process, thus preventing an undesired overheating of the aerosol-forming substrate. Accordingly, the conductive magnetic material of the heating element may be chosen such as to have a Curie temperature corresponding to a predefined maximum heating temperature of the aerosol-forming substrate.

The AC driving current may be a bi-polar AC driving current and/or an AC driving without DC component or without DC offset or with a DC component equal to zero.

Advantageously, the Curie temperature of the conductive ferromagnetic or ferrimagnetic material of the heating element is in a range between 150° C. (degree Celsius) and 500° C. (degree Celsius), in particular between 250° C. (degree Celsius) and 400° C. (degree Celsius), preferably between 270° C. (degree Celsius) and 380° C. (degree Celsius).

The skin depth depends not only on the magnetic permeability but also on the resistivity of the conductive heating element as well as on the frequency of the AC driving current. Thus, the skin depth can be reduced by at least one of decreasing the resistivity of the conductive heating element, increasing the magnetic permeability of the conductive heating element or increasing the frequency of the AC driving current. Accordingly, the (initial) effective resistance and, thus, the heating efficiency of the heating element can be significantly increased by a proper choice of the material properties of the heating element, in particular by having a heating element which comprises an electrically conductive material having at least one of a low resistivity or a high magnetic permeability.

Preferably, the heating element comprises a conductive ferromagnetic or ferrimagnetic material having an absolute magnetic permeability of at least 10 μH/m (microhenry per meter), in particular at least 100 μH/m, preferably of at least 1 mH/m (millihenry per meter), most preferably at least 10 mH/m or even at least 25 mH/m. Likewise, the conductive ferromagnetic or ferrimagnetic material may have a relative magnetic permeability of at least 10, in particular at least 100, preferably at least 1000, most preferably at least 5000 or even at least 10000.

For example, at least a portion of the heating element may comprise or may be substantially made of at least one of: a nickel-cobalt ferrous alloy (such as for example, Kovar or Fernico 1), a mu-metal, permalloy (such as for example, permalloy C), or ferritic stainless steel or a martensitic stainless steel.

As used herein, the term "electrical heating assembly of an aerosol-generating device" refers to an electrical heating assembly as sub-unit of an aerosol-generating device. As such, the electrical heating assembly is at least suitable for being used in an aerosol-generating device.

Having the heating element comprising an electrically conductive ferromagnetic or ferrimagnetic material does not exclude that at least a portion of the heating element may also comprise or substantially be made of an electrically conductive paramagnetic material, for example tungsten, aluminum, or austenitic stainless steel.

The effective resistance and, thus, the heating efficiency of the heating element can be significantly increased when passing a high frequency AC driving current therethrough. Advantageously, the AC driving current has a frequency in a range between 500 kHz (kilohertz) and 30 MHz (megahertz), in particular between 1 MHz and 10 MHz, preferably between 5 MHz and 7 MHz. Accordingly, the control circuit preferably is configured to provide an AC driving current having a frequency in a range between 500 kHz and 30 MHz, in particular between 1 MHz and 10 MHz, preferably between 5 MHz and 7 MHz.

According to a preferred aspect of the invention, an AC resistance of the heating element is in a range between 10 mΩ (milliohm) and 1500 mΩ (milliohm), in particular between 20 mΩ and 1500 mΩ, preferably between 100 mΩ and 1500 mΩ, with regard to an AC driving current passing through the heating element having a frequency in a range between 500 kHz and 30 MHz, in particular between 1 MHz and 10 MHz, preferably between 5 MHz and 7 MHz. An AC resistance in this range advantageously provides a sufficiently high heating efficiency. The aforementioned ranges preferably relate to a temperature range of the heating element between room temperature and the Curie temperature of the conductive ferromagnetic or ferrimagnetic material.

The electrically operated aerosol-generating device which the heating assembly according to the invention is to be used with may be preferably operated by a DC power supply, for example by a battery. Therefore, the control circuit preferably comprises at least one DC/AC inverter for providing the AC driving current.

According to a preferred aspect of the invention, the DC/AC inverter comprises a switching power amplifier, for example a Class-E amplifier or a Class-D amplifier. Class-D and Class-E amplifiers are known for minimum power dissipation in the switching transistor during the switching transitions. Class-E power amplifiers are particularly advantageous as regards operation at high frequencies while at the same time having a simple circuit structure. Preferably, the class-E power amplifier is a single-ended first order class-E power amplifier having a single transistor switch only.

The switching power amplifier, in particular in case of a Class-E amplifier, may comprise a transistor switch, a transistor switch driver circuit, and a LC load network, wherein the LC load network comprises a series connection of a capacitor and an inductor. In addition, the LC load network may comprise a shunt capacitor in parallel to the series connection of the capacitor and the inductor and in parallel to the transistor switch. The small number of these components allows for keeping the volume of the switching power amplifier extremely small, thus allowing to keep the overall volume of the heating assembly very small, too.

The transistor switch of the switching power amplifier can be any type of transistor and may be embodied as a bipolar-junction transistor (BJT). More preferably, however, the transistor switch is embodied as a field effect transistor (FET) such as a metal-oxide-semiconductor field effect transistor (MOSFET) or a metal-semiconductor field effect transistor (MESFET).

In the afore-mentioned configuration, the control circuit may additionally comprise at least one bypass capacitor connected in parallel to the heating element, in particular in parallel to a resistive conductor path though the heating element. For this, it is to be noted that the heating element not only constitutes a resistance, but also a (small) inductance. Accordingly, in an equivalent circuit diagram, the heating element can be represented by a series connection of a resistance and an inductor. By a suitable selection of a capacity of the bypass capacitor, the inductor/inductance of the heating element and the bypass capacitor form a LC resonator through which a major portion of the AC driving current passes through, whereas only a minor portion of the AC driving current passes through the transistor switch via the inductor and the capacitor of the LC network. Due to this, the bypass capacitor advantageously causes a reduction of heat transfer from the heating element towards the control circuit. Advantageously, a capacity of the bypass capacitor is larger, in particular at least two times, preferably at least five times larger, most preferably at least ten times larger than a capacity of the capacitor of the LC network.

Moreover, the bypass capacitor and preferably also the inductor of the LC network may be arranged closer to the heating element than to the rest of the control circuit, in particular as close as possible to the heating element.

For example, the inductor of the LC network and the bypass capacitor may be embodied as separate electronic components remotely arranged from the remaining components which in turn may be arranged on a PCB (printed circuit board). The bypass capacitor may be directly connected to the heating element.

For powering the control circuit and the heating element the heating assembly may further comprise a power supply, preferably a DC power supply, which is operatively connected with the control circuit, and thus with the heating element via the control circuit. The DC power source generally may comprise any suitable DC power source, for example one or more single-use batteries, one or more rechargeable batteries, or any other suitable DC power source capable of providing the required DC supply voltage and the required DC supply amperage. The DC supply voltage of the DC power source may be in a range of about 2.5 V (Volts) to about 4.5 V (Volts) and the DC supply amperage is in a range of about 1 to about 10 Amperes (corresponding to a DC supply power in a range of about 2.5 W (Watts) and about 45 W (Watts).

As a general rule, whenever the term "about" is used in connection with a particular value throughout this application this is to be understood such that the value following the term "about" does not have to be exactly the particular value due to technical considerations. However, the term "about" used in connection with a particular value is always to be understood to include and also to explicitly disclose the particular value following the term "about".

Depending on the conditions of the aerosol-forming substrate to be heated, the heating element may have different geometrical configurations. For example, the heating element may be of a blade configuration or a rod configuration or pin configuration. That is, the heating element may be or may comprise one or more blades, rods or pins which include or substantially are made of an electrically conductive material. These configurations are particularly suitable for use with solid or paste-like aerosol-forming substrates. In particular, these configurations readily allow for penetrating into an aerosol-forming substrate when the heating element is to be brought into contact with the aerosol-forming substrate to be heated. At a proximal end, the blade-shaped or rod-shaped heating element may comprise a tapered tip portion allowing to readily penetrate into an aerosol-forming substrate.

Preferably, the heating element comprises a least one blade which includes or substantially is made of an electrically conductive material, in particular an electrically conductive solid material. The blade may comprise a tapered tip portion facilitating the blade to penetrate into the aerosol-forming substrate to be heated. The blade may have a length in a range between 5 mm (millimeter) and 20 mm (millimeter), in particular between 10 mm and 15 mm; a width in arrange between 2 mm and 8 mm, in particular between 4 mm and 6 mm; and a thickness in a range between 0.2 mm and 0.8 mm, in particular between 0.25 mm and 0.75 mm.

Alternatively, the heating element may be of a wick configuration or a mesh configuration. That is, the heating element may be or may comprise one or more meshes or wicks which include or substantially are made of an electrically conductive material. The latter configurations are particularly suitable for use with liquid aerosol-forming substrates.

An outer surface of the heating element may be surface treated or coated. That is, the heating element may comprise a surface treatment or coating. The surface treatment or coating may be configured to at least one of: to avoid aerosol-forming substrate sticking to the surface of the heating element, to avoid material diffusion, for example metal diffusion, from the heating element into the aerosol-forming substrate, to improve the mechanical stiffness of the heating element. Preferably, the surface treatment or coating is electrically non-conductive.

In general, the heating element may comprise at least one resistive conductor path for passing the AC driving current therethrough. As used herein, the term 'conductor path' refers to a predefined current path for the AC driving current to pass through the heating element. This path is basically given by the geometric configuration of the electrical conductive material of the heating element.

The heating element may comprise a single resistive conductor path. Alternatively, the heating element may comprise a plurality of resistive conductor paths in parallel with each other for passing the AC driving current therethrough.

In the latter configuration, the plurality of resistive conductor paths may merge within a common section of the heating element. Advantageously, this provides a compact design of the heating element. In this configuration, a switching power amplifier of the control circuit may comprise at least one LC network as described for each one of the plurality of parallel resistive conductor paths. Likewise, a switching power amplifier of the control circuit may comprise at least one bypass capacitor—as described above—for each one of the plurality of parallel resistive conductor paths in order to reduce the heat transfer from the heating element to the control circuit.

The at least one resistive conductor path or at least one of the plurality of resistive conductor paths may comprises two feeding points to supply the respective heating path with the AC driving current. Preferably, the two feeding points are arranged at one side of the heating element. This arrangement provides a compact design of the heating element and also facilitates to operatively couple the heating element with the control circuit.

The at least one resistive conductor path or at least one of the plurality of resistive conductor paths may comprises two feeding points to supply the respective heating path with the AC driving current. Preferably, the two feeding points are arranged at one side of the heating element. This arrangement allows for a compact design of the heating element and also facilitates to operatively couple the heating element with the control circuit.

The heat dissipation along the conductor path and thus the heating efficiency of the heating element increases with increasing length of the conductor path. Therefore, the geometric configuration of the resistive conductor path preferably is such as to have a path length as long as possible.

The at least one resistive conductor path or at least one of the plurality of resistive conductor paths may be formed by at least one section-wise slitting of the heating element. As a result, the at least one resistive conductor path or at least one of the plurality of resistive conductor paths may be formed by at least one slit, wherein the heating element is fully disrupted by the slit along a depth extension of the slit and only partially disrupted by the slit along a length extension of the slit.

For example, a blade-shaped or rod-shaped heating element, made of a solid conductive material, may comprise one slit starting at one edge of the heating element but only partially extending along a length portion of the heating element such as to provide a U-shaped conductor path.

Likewise, the heating element may comprise two parallel slits which start at the same edge of the heating element but which only partially extend along a length portion of the heating element such as to provide two parallel U-shaped conductor paths having one central branch in common.

In case of a plurality of resistive conductor paths, the control circuit may comprise a respective bypass capacitor for each resistive conductor path connected in parallel thereto.

According to preferred aspect of the invention, the heating element may be a multi-layer heating element comprising a plurality of layers, in particular at least two layers. Advantageously, a multi-layer setup of the heating element allows for combining different functionalities and effects, wherein each layer preferably provides at least one specific function or effect. For this, the different layers may comprise different materials and/or may have different geometrical configurations, in particular different layer thicknesses.

A multi-layer setup may prove advantageous in particular with regard to the heating element according to the present invention which comprises an electrically conductive ferromagnetic or ferrimagnetic material. Ferrimagnetic or ferromagnetic materials, in particular those having a high magnetic permeability, may be rather ductile. Therefore, the heating element advantageously is a multi-layer heating element comprising at least one support layer and at least one heating layer. At least the heating layer comprises an electrically conductive ferromagnetic or ferrimagnetic material for heating the aerosol-forming substrate. In contrast, the support layer advantageously comprises a material which is less ductile as compared to the ferromagnetic or ferrimagnetic material of the heating layer. In particular, a bending and/or a rotational stiffness of the support layer is larger than a bending and/or a rotational stiffness of the heating layer. Such a configuration advantageously combines both, high mechanical stiffness due to the support layer, and high AC resistance and thus high heating efficiency due to the at least one ferromagnetic or ferrimagnetic heating layer.

According to a preferred embodiment, the multi-layer heating element comprises at least one support layer and at least two heating layers sandwiching the support layer, wherein at least one of, preferably both heating layers comprises an electrically conductive ferromagnetic or ferrimagnetic material. Even more preferably, both heating layers comprise or are made of the same electrically conductive ferromagnetic or ferrimagnetic material and have the same thickness. The symmetric setup of the latter configuration proves particularly beneficial as being compensated for tensile or compressive stress states due to possible differences in the thermal expansion behavior of the various layers.

The heating layers may also have different compositions, that is, the heating layers may comprise different materials with different Curie temperatures. Advantageously, this may provide additional information on the heating temperature, for example, for calibration or temperature control purposes.

Preferably, the at least one heating layer or the two heating layers sandwiching the support layer are edge layers of the multi-layer heating element. This facilitates a direct heat transfer from the heating element to the aerosol-forming substrate.

To ensure sufficient mechanical stiffness, at least one layer of the multi-layer heating assembly, preferably at least the support layer is made of a solid material. More preferably, all layers are made of a respective solid material.

Furthermore, a layer thickness of the at least one support layer may be larger than a layer thickness of the at least one or two heating layers. This also facilitates to provide sufficient mechanical stiffness.

The at least one support layer may be made of an electrically non-conductive material. Accordingly, the support layer separates the two sandwiching heating layers from each other such as to operate the two heating layers in parallel. Alternatively, the two sandwiching heating layers may be operated in series while still being separated by the electrically non-conductive support layer arranged in between. For this, the heating layers may be electrically connected at one end, in particular at a proximal end of the heating element. In this configuration, the electrically non-conductive support layer is not only used for stiffening the heating element, but also to form a single conductor path through the heating element which consists of the series connection of the two heating layers.

The at least one support layer may also comprise an electrically conductive material. In this case, an AC resistance of the support layer preferably is different from, preferably lower than an AC resistance of the at least one heating layer. In particular in case the at least one heating layer is an edge layer, the AC driving current is expected to flow at least partially or even mostly within the heating layer, though the AC resistance of the support layer could be lower than the AC resistance of the heating layer. As a consequence, heat dissipation mainly occurs within the heating layer. Moreover, as compared to the layer with the lowest AC resistance taken alone, the overall AC resistance of the multi-layer heating element having layers with different AC resistances may be significantly increased.

Accordingly, a resistivity of the electrically conductive material of the at least one heating layer may be larger than a resistivity of the electrically conductive material of the at least one support layer.

Alternatively or additionally, a relative magnetic permeability of the electrically conductive material of the at least one or two heating layers is larger than a relative magnetic permeability of the electrically conductive material of the at least one support layer. Preferably, the electrically conductive material of the at least one support layer is paramagnetic, for example tungsten, aluminum, or austenitic stainless steel.

Each of the layers may be plated, deposited, coated, cladded or welded onto a respective adjacent layer. In particular, any layer may be applied onto a respective adjacent layer by spraying, dip coating, roll coating, electroplating, cladding or resistance welding.

The multi-layer heating element may be of a rod configuration or a pin configuration or a blade configuration. In the latter case, each layer itself may be of a blade configuration. In case of a rod or pin configuration, the multi-layer heating element may comprises an inner core as support layer which is surrounded or encapsulated or coated by an outer jacket as heating layer. The rod-shaped heating element may comprise a central longitudinal slit extending only along a length portion of the heating element from its distal end towards its proximal end such as to provide a U-shaped conductor path therethrough.

Alternatively, a rod-shaped multi-layer heating element may comprise an inner core as first heating layer and an outer jacket as second heating layer. Between the inner core and the outer jacket, the heating element may further comprise as support layer an intermediate sleeve made of an electrically non-conductive material such as to separate the first and second heating layers. However, the inner core and the outer jacket may be electrically connect at one end, preferably at the proximal end of the rod-shaped heating element such as to provide a conductor path between the first and second heating layer.

In order to reduce the heat transfer from the heating element towards the control circuit, the heating assembly may further comprise an electrically conductive connector operatively coupling the control circuit with the heating element. An AC resistance of the connector is lower than the AC resistance of the heating element. Due to the lower AC resistance, heat generation caused by Joule heating is significantly reduced in the conductive connector as compared to the heating element.

Advantageously, the electrically conductive connector has an AC resistance of 25 mΩ at the most, in particular of 15 mΩ at the most, preferably of 10 mΩ at the most, most preferably of 10 mΩ at the most, with regard to an AC driving current passing through the heating element having a frequency in a range between 500 kHz and 30 MHz, in particular between 1 MHz and 10 MHz, preferably between 5 MHz and 7 MHz.

The AC resistance of the conductive connector may be reduced or minimized by increasing the skin depth. The skin depth in turn increases with at least one of decreasing resistivity or decreasing magnetic permeability of the conductive connector. Accordingly, the material properties of the conductive connector are preferably chosen such as to have at least one of a low resistivity or a low magnetic permeability. In particular, a relative magnetic permeability of an electrically conductive material of the connector preferably is lower than a relative magnetic permeability of an electrically conductive material of the heating element. Advantageously, the electrically conductive material of the connector is paramagnetic. For example, the heating element may be made of permalloy C, whereas the connector may be made of tungsten.

In addition or alternatively, the heating assembly may further comprise a heat absorber thermally coupled to at least one of the control circuit or the connector in order to absorb any excess heat and thus to reduce any adverse heat effects on the control circuit. The heat absorber may, for example, comprise a heat sink or a heat reservoir or a heat exchanger.

In the latter case, the heat exchanger may in particular comprise at least one thermoelectric generator. A thermoelectric generator is an energy converting device for converting heat into electrical power based on the Seebeck principle. Preferably, the at least one thermoelectric generator is operatively connected to a power supply of the heating assembly or directly to the control circuit. As an example, the thermoelectric generator may be operatively connected to a battery in order to feed in converted electrical power for recharging purposes.

In case the heat absorber is a heat reservoir, the heat absorber comprises a phase change material (PCM). A phase change material is a substance with a high heat of fusion capable of storing and releasing large amounts of energy when the material changes its phase from solid to liquid, solid to gas, or liquid to gas and vice versa. The PCM may be inorganic, for example, a salt hydrates. Alternatively, the PCM may be organic, for example, paraffin or a carbohydrate.

As heat sink, the heat absorber may comprise cooling fins or cooling rips in thermal contact with least one of the control circuit or the connector. When the heating assembly is installed in an aerosol-generating device, the cooling fins or cooling rips may be arranged within an airflow passage of the aerosol-generating device such as to allow heat to be dissipated dissipation into the airflow passage.

As mentioned above, the heating element may be configured to act as temperature sensor, in particular for controlling the temperature of the aerosol-forming substrate, preferably for adjusting the actual temperature. This possibility relies on the temperature dependent resistance characteristic of the resistive material used to build up the resistive heating element. The heating assembly may further comprise a readout device for measuring the resistance of the heating element. The readout device may be part of the control circuit. The measured temperature directly corresponds to the actual temperature of the heating element. The measured temperature may also be indicative for the actual temperature of the aerosol-forming substrate, depending on the positioning of the heating element relative to the aerosol-forming substrate to be heated and the given characteristics of the heat supply from the heating element to the aerosol-forming substrate.

The heating assembly, in particular the control circuit may further comprise a temperature controller for controlling the temperature of the heating element. For this, the temperature controller preferably is configured for controlling the AC driving current passing through the heating element In particular, the temperature controller may be operatively coupled to the aforementioned readout device for measuring the resistance and thus the temperature of the heating element.

According to the invention there is also provided an aerosol-generating device for use with an aerosol-forming substrate, wherein the aerosol-generating device comprises a heating assembly according to the invention and as described herein.

As used herein, the term 'aerosol-generating device' is used to describe an electrically operated device that is capable of interacting with at least one aerosol-forming substrate to generate an aerosol by heating the substrate. Preferably, the aerosol-generating device is a puffing device for generating an aerosol that is directly inhalable by a user thorough the user's mouth. In particular, the aerosol-generating device is a hand-held aerosol-generating device.

As used herein, the term 'aerosol-forming substrate' refers to substrate that is capable of releasing volatile compounds that can form an aerosol. The aerosol-forming substrate may be a solid or a liquid aerosol-forming substrate. In both conditions, the aerosol-forming substrate may comprise at least one of solid or liquid components. In particular, the aerosol-forming substrate may comprise a tobacco-containing material including volatile tobacco flavour compounds, which are released from the substrate upon heating. Thus, the aerosol-forming substrate may be a tobacco-containing aerosol-forming substrate. The tobacco-containing material may comprise loosed filled or packed tobacco, or sheets of tobacco which have been gathered or crimped. Alternatively or additionally, the aerosol-forming substrate may comprise a non-tobacco material. The aerosol-forming substrate may further comprise an aerosol former. Examples of suitable aerosol formers are glycerine and propylene glycol. The aerosol-forming substrate may also comprise other additives and ingredients, such as nicotine or flavourants, in particular tobacco flavourants. The aerosol-forming substrate may also be a paste-like material, a sachet of porous material comprising aerosol-forming substrate, or, for example, loose tobacco mixed with a gelling agent or sticky agent, which could include a common aerosol former such as glycerine, and which is compressed or molded into a plug.

The aerosol-forming substrate may be part of an aerosol-generating article, preferably a consumable, to interact with the aerosol-generating device for generating an aerosol. For example, the article may be rod-shaped aerosol-generating article resembling the shape of a conventional cigarette which comprises a solid, preferably tobacco-containing aerosol-forming substrate. Alternatively, the article may be a cartridge comprising a liquid, preferably tobacco-containing aerosol-forming substrate.

The aerosol-generating device may comprise a receiving chamber for receiving the aerosol-forming substrate or the aerosol-generating article comprising the aerosol-forming substrate to be heated. Preferably, the receiving chamber is arranged at a proximal end of the aerosol-generating device. The receiving chamber may comprise a receiving opening for inserting the aerosol-forming substrate into the receiving chamber. As an example, the aerosol-generating device may include a cavity for receiving an aerosol-generating article comprising a solid aerosol-forming substrate, or a cartridge comprising a liquid aerosol-forming substrate as described above. Alternatively the aerosol-generating device may comprise a reservoir for directly receiving a liquid aerosol-forming substrate therein.

The heating element of the heating assembly may be arranged at least partially within the receiving chamber of the aerosol-generating device. The control circuit and—if present—the power of the supply heating assembly may be arranged within a device housing of the aerosol-generating device. Preferably, the heating assembly is powered from a global power supply of the aerosol-generating device.

The aerosol-generating device may further comprise an airflow passage extending through the receiving chamber. The device may further comprise at least one air inlet in fluid communication with the airflow passage.

Further features and advantages of aerosol-generating device according to the invention have been described with regard to the heating assembly and will not be repeated.

According to the invention there is also provided a method for resistively heating an aerosol-forming substrate to generate an aerosol. The method comprises the following steps:

- providing aerosol-forming substrate to be heated;
- providing an electrically resistive heating element comprising an electrically conductive ferromagnetic or ferrimagnetic material for heating the aerosol-forming substrate, the heating element being configured to heat up due to Joule heating when passing an AC driving current therethrough;
- arranging the aerosol-forming substrate in close proximity to or contact with the aerosol-forming substrate;
- providing an AC driving current; and
- passing the AC driving current through the heating element.

Preferably, the method is performed using a heating assembly or an aerosol-generating device according to the invention and as described herein. Vice versa, the heating assembly or the aerosol-generating device according to the invention and as described herein may be operated using the method according to the invention and as described herein.

As described above with regard to the heating assembly, the step of providing an AC driving current advantageously comprises providing an AC driving current having a frequency in a range between 500 kHz and 30 MHz, in particular between 1 MHz and 10 MHz, preferably between 5 MHz and 7 MHz.

As further described above with regard to the heating assembly, the AC driving current may be provided by using a switching power amplifier.

Furthermore, the step of providing an AC driving current using a switching power amplifier may include operating the switching power amplifier with a duty cycle in a range between 20% (percent) and 99% (percent), in particular between 30% and 95%, preferably between 50% and 90%, most preferably between 60% and 90%. Operating the switching power amplifier with a duty cycle in this range advantageously causes the temperature of the control circuit to remain reasonable low without the risk of thermal damages of the control circuit while still allowing the heating element to reach temperatures sufficiently high for aerosol generation.

Further features and advantages of the method according to the invention have been described with regard to heating assembly and the aerosol-generating device and will not be repeated.

Figure 2:
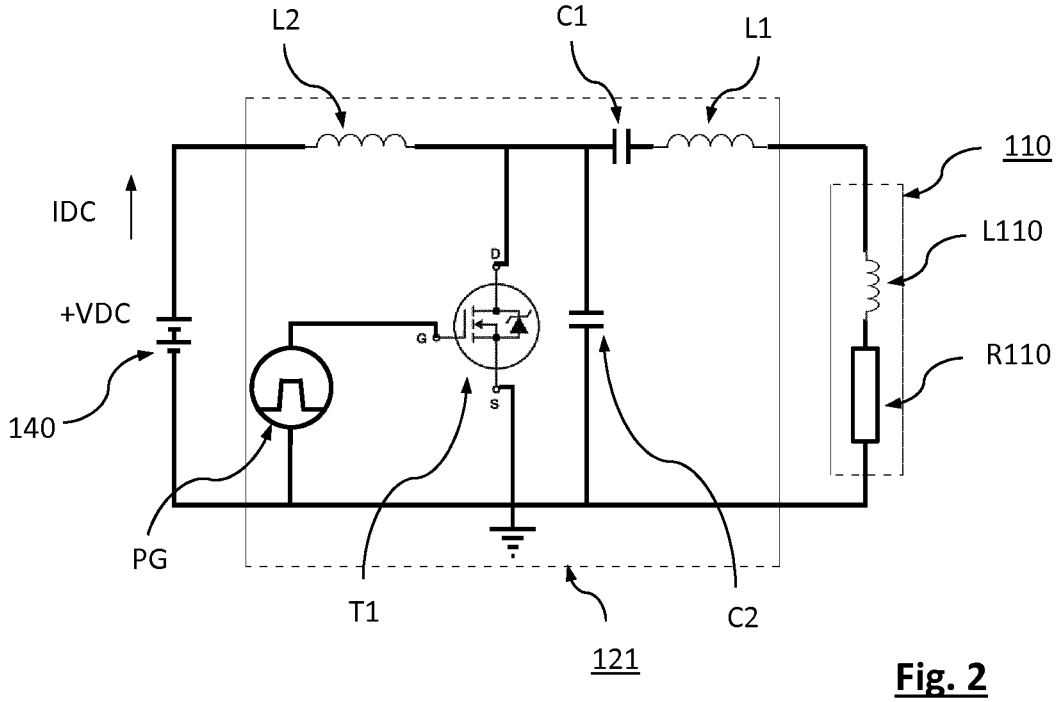
Figure 3:
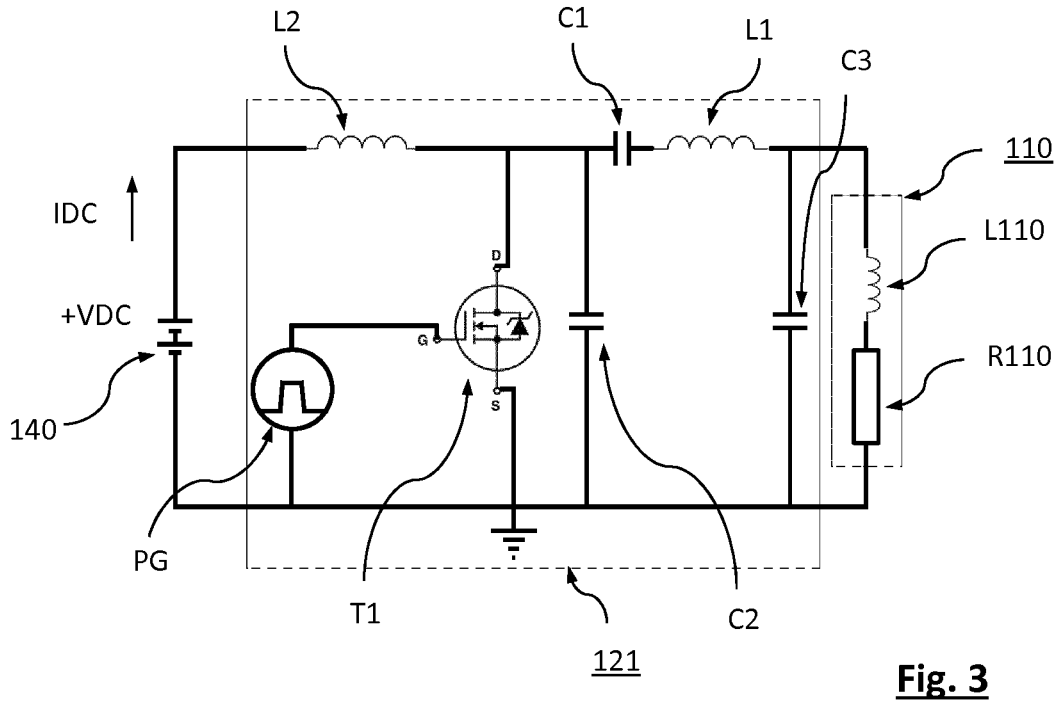
Figure 8:
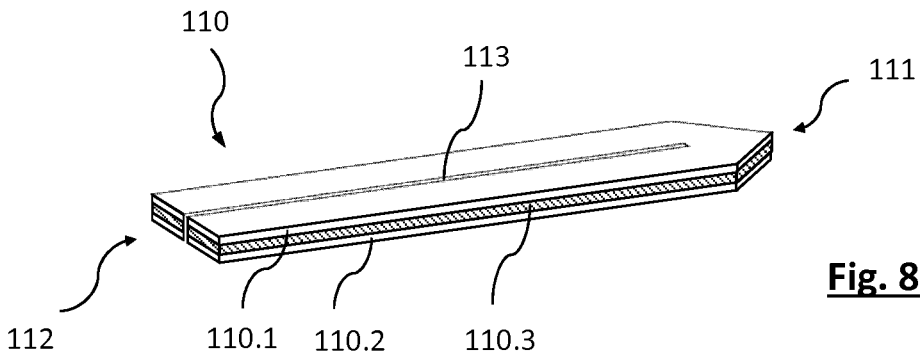
Figure 9:
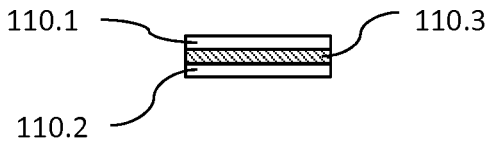
Figure 10:
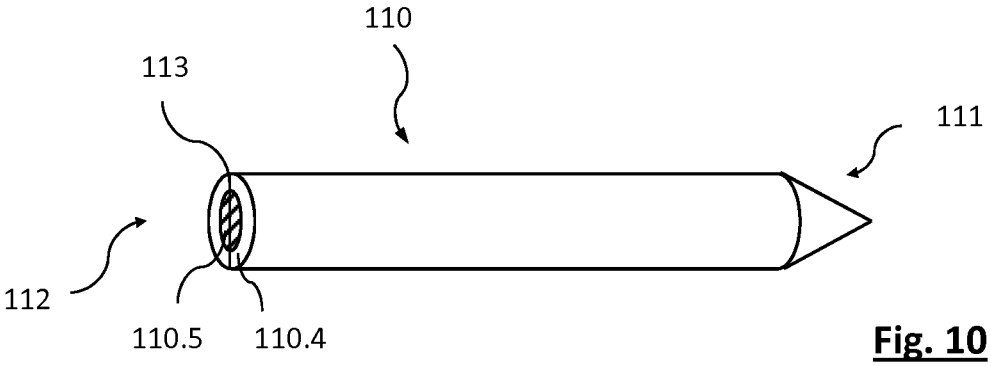
Figure 11:
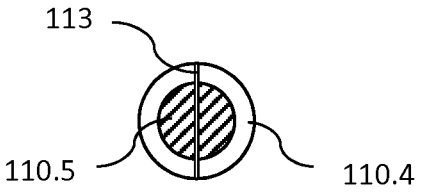

The invention will be further described, by way of example only, with reference to the accompanying drawings, in which:

FIG. 1 schematically illustrates an exemplary embodiment of an aerosol-generating device comprising an electrical heating assembly according to the present invention for resistively heating an aerosol-forming substrate;

FIGS. 2-3 schematically illustrate a first and a second embodiment of a circuit diagram of the heating assembly according to FIG. 1;

FIGS. 4-7 schematically illustrate a first, a second, a third and a fourth embodiment of a heating blade according to the invention;

FIGS. 8-9 schematically illustrate an exemplary embodiment of a multi-layer heating blade according to the invention; and FIGS. 10-11 schematically illustrate an exemplary embodiment of a multi-layer heating rode according to the invention.

FIG. 1 schematically illustrates an exemplary embodiment of an aerosol-generating device 1 comprising an electrical heating assembly 100 according to the present invention for resistively heating an aerosol-forming substrate 210.

The aerosol-generating device 1 comprises a device housing 10 which includes a receiving chamber 20 at a proximal end 2 of the device 1 for receiving the aerosol-forming substrate 210 to be heated. In the present embodiment, the aerosol-forming substrate 210 is a solid tobacco-containing aerosol-forming substrate. The substrate 210 is part of a rod-shaped aerosol-generating article 200. The article 200 resembles the shape of a conventional cigarette and is configured to be received with in the receiving chamber 20 of the device 1. In addition to the aerosol-forming substrate 210, the article 200 comprises a support element 220, an aerosol-cooling element 230 and a filter element 240. All these elements are arranged sequentially to the aerosol-forming substrate 210, wherein the substrate is arranged at a distal end of the article 200 and the filter element is arranged at a proximal end of the article 200. The substrate 210, the support element 220, the aerosol-cooling element 230 and the filter element 240 are surrounded by a paper wrapper which forms the outer circumferential surface of the article 200.

The main concept of the heating assembly according to the present invention is based on passing an AC driving current through a resistive heating element 110 which in turn is in thermal proximity or even in close contact with the aerosol-forming substrate 210. Using an AC driving current advantageously allows for using a massive and thus mechanically robust heating element which still provides sufficient Joule heating (due to the skin effect) such as to reach temperatures in a range suitable for heating the aerosol-forming substrate 210.

In the embodiment of the heating assembly 100 as shown in FIG. 1, the heating element 110 is a blade made of a solid electrically conductive ferromagnetic material, for example permalloy, having an AC resistance R in a range between 10 mΩ and 1500 mΩ for an AC driving having a frequency in a range between 500 kHz and 30 MHz. Preferably, the heating blade 210 is made of a solid material. Advantageously, a resistance in this range is sufficiently high for heating the aerosol-forming substrate 210. At the same time, the heating element 110 provides sufficient mechanical stability to get in and out of contact with aerosol-forming substrate 210 without the risk of deformation or breakage. In particular, the blade-shaped configuration of the heating element 110 enables to readily penetrate into the aerosol-forming substrate 210 when inserting the aerosol-generating article 200 into the receiving chamber 20 of the aerosol-generating device 1.

As can be further seen in FIG. 1, the heating blade 110 is fixedly arranged within the device housing 10 of the aerosol-generating device 1, extending centrically into the receiving chamber 20. A tapered proximal tip portion at the proximal end 111 of the heating blade 110 faces towards to a receiving opening at the proximal end 2 of the device 1.

In addition to the heating element 110, the heating assembly 100 comprises a control circuit 120 which is operatively coupled with the heating element 110 and configured to provide an AC driving current in a range between 500 kHz and 30 MHz. Thus, when passing the AC driving current through the heating element 110 the latter heats up due to Joule heating.

The control circuit 120, and thus the heating process, is powered by a DC power supply 140. In the present embodiment, the DC power supply 140 is a rechargeable battery arranged within the device housing 10 at a distal end 3 of the device 1. The battery may be either part of the heating assembly 100 or part of a global power supply of the aerosol-generating device 1 which may be also used for other components of the device 1.

FIG. 2 schematically illustrates a first embodiment of a circuit diagram of the heating assembly 100 as used in the aerosol-generating device 1 shown in FIG. 1. According to this first embodiment, the control circuit 120 basically comprises a DC/AC inverter 121 for inverting the DC current/voltage IDC/+VDC provided by the DC power supply 140 into an AC driving current in a range between 500 kHz and 30 MHz for operating the heating element 110.

In the present embodiment, the DC/AC inverter 121 comprises a Class-E amplifier. The Class-E amplifier comprises a transistor switch T1, for example a Metal-Oxide-Semiconductor Field Effect Transistor (MOSFET), a transistor switch driver circuit PG, and a LC load network. The LC load network comprises a series connection of a capacitor C1 and an inductor L1. In addition, the LC load network comprises a shunt capacitor C2 in parallel to the transistor switch T1 and in parallel to a series connection of the capacitor C1 and the inductor L1. Furthermore, the control circuit comprises a choke L2 for supplying the DC supply voltage +VDC to the Class-E amplifier. As mentioned further above, the heating element not only constitutes a resistance, but also a (small) inductance. Therefore, in the circuit diagram according to FIG. 2, the heating element 110 is represented by a series connection of a resistance R110 and an inductor L110. The resistive load R110 of the heating element 110 may also represent the resistive load of the inductor L1. The small number of these components allows for keeping the volume of the DC/AC inverter 121 extremely small, thus allowing to keep the overall volume of the heating assembly 100 very small, too.

The general operating principle of the Class-E amplifier is well known in general. For further details of the Class-E amplifier and its general operating principle reference is made, for example, to the article "Class-E RF Power Amplifiers", Nathan O. Sokal, published in the bimonthly magazine QEX, edition January/February 2001, pages 9-20, of the American Radio Relay League (ARRL), Newington, 5 CT, U.S.A. The aforementioned article also describes the relevant equations to be considered for dimensioning the various components of the DC/AC inverter 121. In the first embodiment as shown in FIG. 2, the inductor L1 may have an inductance in a range between 50 nH (nanohenry) and 200 nH (nanohenry), the inductor L2 may have an inductance in a range between 0.5 μH (microhenry) and 5 μH (microhenry), and the capacitors C1 and C2 may have a capacitance in a range between 1 nF (nanofarad) and 10 nF (nanofarad).

FIG. 3 schematically illustrates a second embodiment of a circuit diagram of the heating assembly 100. The circuit diagram according to this second embodiment is very similar to the first embodiment shown in FIG. 2. Therefore, identical or similar components are denoted with identical reference signs. In addition to the circuit diagram of FIG. 2, the circuit diagram of the second embodiment comprises a bypass capacitor C3 connected in parallel to the heating element 110, that is, in parallel to the series connection of the resistance R110 and the inductor L110. Advantageously, the capacity of the bypass capacitor C3 is larger, in particular at least two times, preferably at least five times larger, most preferably at least ten times larger than the capacity of the capacitor C1 of the LC network. Accordingly, the bypass capacitor C3 and the inductor L110 of the heating element 110 form a LC resonator through which a major portion of the AC driving current passes through, whereas only a minor portion of the AC driving current passes through the transistor switch via the inductor L1 and the capacitor C1 of the LC network. Due to this, the bypass capacitor C3 advantageously causes a reduction of heat transfer from the heating element 110 towards the control circuit 120, in particular towards the transistor switch T1. The bypass capacitor C3 is arranged close to the heating element 110, but possibly far away from the remaining parts of the control circuit 120. The remaining parts of the control circuit 120 are preferably arranged on a PCB (printed circuit board).

Heat transfer from the heating element 110 towards the control circuit 120 may be further reduced by providing an electrically conductive connector operatively coupling the control circuit 120 with the heating element 110, wherein an AC resistance of the connector 130 is lower than the AC resistance of the heating element 110. This may be achieved, for example, by choosing suitable electrically conductive materials for the connector 130 and the heating element 110. In particular, the respective materials may be chosen such that a relative magnetic permeability of an electrically conductive material of the connector 130 is lower than a relative magnetic permeability of an electrically conductive material of the heating element 110. Due to this, the skin depth is larger and thus the AC resistance is lower in the connector 130 than in the heating element 110. Preferably, the electrically conductive material of the connector 130 is paramagnetic. In the embodiment as shown in FIG. 1, the heating element 120 is operatively coupled by two connector elements 131, 132 which for example are made of tungsten, whereas the heating element 110 is made of permalloy C.

Additionally or alternatively, the heating assembly may comprise a heat absorber which is thermally coupled to at least one of the control circuit 120 or the connector 130 for reducing any adverse heat effects on the control circuit 120. For example, the inductor L1 of the LC circuit shown in FIG. 2 and FIG. 3 may be embedded in a heat absorbing material, for example in a high temperature cement.

Figure 4:
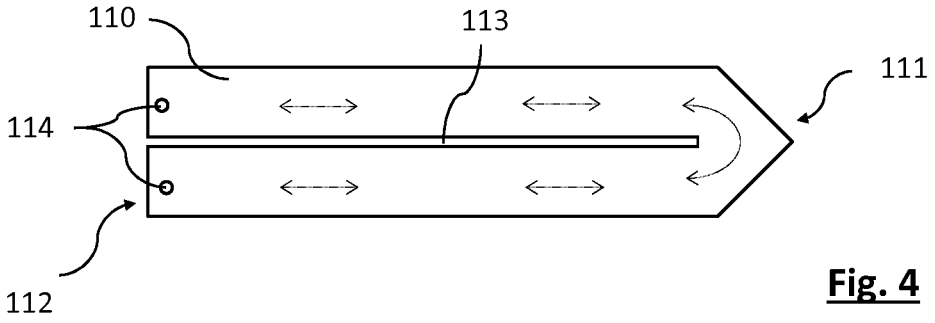

FIG. 4 shows an enlarged view of the resistive heating blade 110 as used in the heating assembly 110 according to FIG. 1. In this embodiment, the heating blade comprises a central longitudinal slit 113 extending from a distal end 112 towards a proximal end 111 of the heating blade. However, the heating blade 110 is only partially disrupted by the slit 113 along a length extension of the blade. In contrast, the blade is fully disrupted by the slit 113 along a depth or thickness extension of the blade 110. As a result, the heating blade provides a U-shaped conductor path for the AC driving current (indicated by dashed double arrows) to pass through the blade. At its distal end 112, the conductor path comprises two feeding points 114 for supplying the AC driving current.

At its proximal end 111, the heating blade 110 comprises a tapered tip portion allowing the blade to readily penetrate into the aerosol-forming substrate 210 of the article 200.

The heating blade 110 may have a length in a range between 5 mm (millimeter) and 20 mm (millimeter), in particular, between 10 mm and 15 mm, a width in arrange between 2 mm and 8 mm, in particular, between 4 mm and 6 mm, and a thickness in a range between 0.2 mm and 0.8 mm, in particular between 0.25 mm and 0.75 mm.

Figure 5:
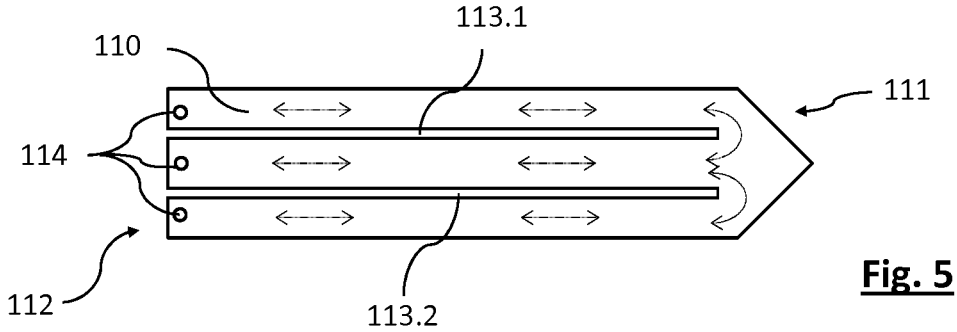

FIG. 5 shows a second embodiment of the heating blade 110. In contrast to FIG. 4, the heating blade 110 according to this second embodiment comprises two longitudinal slits 113.1, 113.2 extending parallel to each other along a length portion of the heating blade 110. As a result, the heating blade 110 provides two parallel U-shaped conductor paths for the AC driving current to pass through the blade, wherein the two paths indicated by dashed double arrows) have one common branch. Accordingly, the conductor paths comprises in total three feeding points 114 for supplying the AC driving current. Having two paths in parallel advantageously causes an increase of the dissipated heat and, thus, an increase of the heating efficiency.

Figure 6:
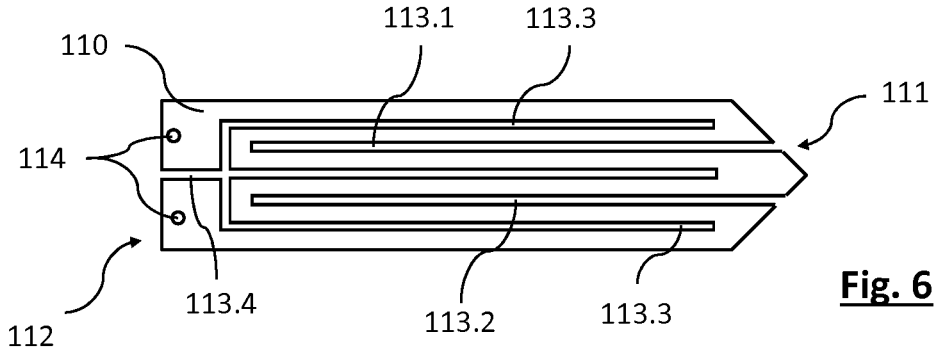
Figure 7:
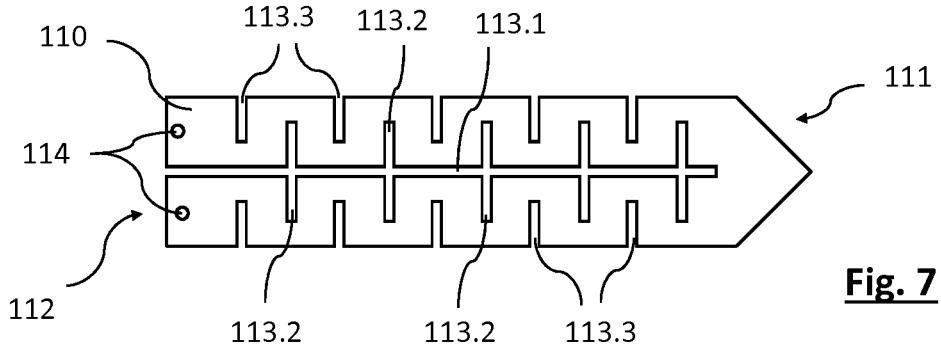

FIG. 6 and FIG. 7 show a third and a fourth embodiment of the heating blade 110 which also aim to increase the heat dissipation and, thus, the heating efficiency. In both embodiments, the heating blade 110 comprises a plurality of section-wise slits 113 resulting in a single conductor path having a meander-like or zig-zag-like configuration. Due to this, the total length of the conductor path and thus, the total amount of dissipated heat is significantly increased as compared to the configuration shown in FIG. 4.

According to the third embodiment shown in FIG. 6, the heating blade 110 comprises two longitudinal slits 113.1, 113.2 parallel to each other along a length portion of the heating blade 110. The two longitudinal slits 113.1, 133.2 extend from the proximal end 111 towards the distal end 112 of the blade 110, yet not reaching the latter. In addition, the heating blade 110 comprises a U-shaped slit 113.3 which at least partially encloses the two parallel slits 113.1, 113.2. A base portion of the U-shaped slit 113.3 is arranged in a distal portion of the heating blade 110, whereas the branches of the U-shaped slit 113.3 extend towards the proximal end 111 of the blade 110, yet not reaching the latter. Furthermore, the heating blade 110 comprises a central longitudinal slit 113.4 extending along a length portion of the heating blade 110 from a distal end 112 towards a proximal end 111 of the heating blade 110, yet not reaching the latter. As can be seen from FIG. 6, the central longitudinal slit 113.4 extends parallel to and at least partially between the two longitudinal slits 113.1 and crosses the base portion of the U-shaped slit 113.3. As a result, slits 113.1, 113.2, 113.3, 113.4 provide a meander-shaped or zig-zag-shaped conductor path.

According to the fourth embodiment shown in FIG. 7, the heating blade 110 comprises a central longitudinal slit 113.1 extending along a length portion of the heating blade 110 from a distal end 112 towards a proximal end 111 of the heating blade 110, yet not reaching the latter. Alongside the central longitudinal slit 113.1, the heating blade 110 further comprises a plurality of transverse slits 113.2 extending towards, but not reaching the longitudinal edges of the blade 110, thereby crossing the central slit 113.1 in a transverse configuration. In addition, the heating blade 110 comprises a plurality of side slits 113.3 arranged along both longitudinal edges of the blade 110. The side slits 113.2 are in an offset configuration relative to the transverse slits 113.2. Each side slit 113.2 extends from a respective longitudinal edge of the blade 110 towards the central longitudinal slit 113.1, yet not reaching the latter. As a result, slits 113.1, 113.2, 113.3, 113.4 provide a meander-shaped or zig-zag-shaped conductor path.

FIG. 8 and FIG. 9 schematically illustrate a first embodiment of a multi-layer heating element 110. The multi-layer heating element is of a blade configuration having an outer shape essentially identical to the heating blade 110 as shown in FIG. 4. Therefore, identical or similar components are denoted with identical reference signs. While the heating blade according to FIG. 4 substantially is made of a single electrically conductive solid material or part, the multi-layer heating blade 110 according to FIGS. 8 and 9 comprises two heating layers 110.1, 110.2 as edge layers and one support layer 110.3 sandwiched between the two heating layers 110.1, 110.2. The heating layers 110.1, 110.2 are made of an electrically conductive ferromagnetic solid material, for example, permalloy. As ferromagnetic materials may be rather ductile, the support layer 110.3 is intended to increase the overall mechanical stiffness of the heating blade 110. For this, the support layer 110.3 comprises an electrically conductive solid material, for example tungsten or stainless steel, which is significantly less ductile than material of the heating layers 110.1, 110.2.

When passing an AC driving current through the heating blade 110, the AC driving current is expected to flow at least partially or even mostly within the heating layers 110.1, 110.2, though the AC resistance of the support layer 110.3 could be lower than the AC resistance of the heating layers 110.1, 110.2. As a consequence, heat dissipation mainly occurs within the heating layers 110.1, 110.2. As compared to the support layer taken alone, the overall AC resistance of the multi-layer heating element is significantly increased.

As can be seen in particular from FIG. 9, which is a cross-sectional view through tapered proximal tip portion of the heating blade 110 according to FIG. 8, at least the two heating layers 110.1, 110.2 have the same layer thickness and are made of the same material. Due to this, the overall setup of the heating blade 110 is symmetric and thus compensated for tensile or compressive stress states due to possible differences in the thermal expansion behavior of the various layers.

In the present embodiment, the various layers 110.1, 110.2, 110.3 are connected to each other by cladding.

FIG. 10 and FIG. 11 schematically illustrate a second embodiment of a multi-layer heating element 110. Instead of a blade-configuration, the heating element 110 according to this embodiment is of a rod configuration. In this configuration, the multi-layer heating element 110 comprises an inner core as support layer 110.5 which is surrounded by an outer jacket as heating layer 110.4. The heating layer 110.4 is made of conductive ferromagnetic solid material, for example, permalloy. In contrast, the support layer 110.5 is made of an electrically conductive solid material, for example tungsten or stainless steel, which is significantly less ductile than material of the heating layer 110.4. As described above with regard to the FIGS. 8 and 9, the support layer 110.5 is intended to increase the overall mechanical stiffness of the rod-shaped heating blade 110. Likewise, when passing an AC driving current through the heating blade 110, the AC driving current is expected to flow at least partially or even mostly within the outer heating layers 110.4 where heat dissipation mainly occurs.

As can be seen in particular from FIG. 11, which is a cross-sectional view through the rod-shaped heating element 110 according to FIG. 10, the heating element 110 comprises a central longitudinal slit 113 extending along a length portion of the heating element from its distal end 112 towards its proximal end 112, such as to provide a U-shaped conductor path therethrough.

At its proximal end 111, the rod-shaped heating element 110 comprises a tapered tip portion allowing the heating rod to readily penetrate into an aerosol-forming substrate.

The invention claimed is:

1. An aerosol-generating device for use with an aerosol-forming substrate comprising a heating assembly for restively heating the aerosol-forming substrate, the heating assembly comprising:

a control circuit configured to provide an AC driving current;

an electrically resistive heating element comprising an electrically conductive ferromagnetic or ferrimagnetic material for heating the aerosol-forming substrate, wherein the heating element is operatively coupled with the control circuit and configured to heat up due to Joule heating when passing an AC driving current provided by the control circuit through the heating element, wherein the heating element is a multi-layer heating element comprising at least one support layer and at least one heating layer, wherein at least the heating layer comprises the electrically conductive ferromagnetic or ferrimagnetic material and is an edge layer of the multi-layer heating element, and wherein a layer thickness of the at least one support layer is larger than a layer thickness of the at least one heating layers.

2. The aerosol-generating device according to claim 1, wherein the multi-layer heating element comprises at least one further heating layer in addition to the at least one heating layer, the at least two heating layers sandwiching the support layer, wherein at least one of the heating layers comprise the electrically conductive ferromagnetic or ferrimagnetic material.

3. The aerosol-generating device according to claim 1, wherein the at least one support layer comprises an electrically conductive material.

4. The aerosol-generating device according to claim 3, wherein a resistivity of the electrically conductive material of the at least one or two heating layers is lower than a resistivity of the electrically conductive material of the at least one support layer.

5. The aerosol-generating device according to claim 1, wherein a relative magnetic permeability of the electrically conductive material of the at least one or two heating layers is larger than a relative magnetic permeability of the electrically conductive material of the at least one support layer.

6. The aerosol-generating device according to claim 1, wherein the electrically conductive material of the at least one or two heating layers is ferromagnetic or ferrimagnetic.

7. The aerosol-generating device according to claim 3, wherein the electrically conductive material of the at least one support layer is paramagnetic.

8. The aerosol-generating device according to claim 2, wherein the two heating layers are edge layers of the multi-layer heating element.

9. The aerosol-generating device according to claim 1, wherein at least one layer of the multi-layer heating element is substantially made of a solid material.

10. The aerosol-generating device according to claim 1, wherein the heating element is of a blade configuration or a rod configuration.

11. The aerosol-generating device according to claim 1, wherein an AC resistance of the heating element is in a range between 10 mΩ and 1500 mΩ for an AC driving current passing through the heating element having a frequency in a range between 500 kHz and 30 MHz.

* * * * *